United States Patent [19]

Kilvert

[11] 4,028,046

[45] June 7, 1977

[54] METHOD OF MOUNTING A CANDLE

[76] Inventor: Charles A. Kilvert, 21 Barnes St., Providence, R.I. 02906

[22] Filed: Oct. 3, 1975

[21] Appl. No.: 619,211

[52] U.S. Cl. ..... 431/297
[51] Int. Cl.[2] ..... F23D 3/16
[58] Field of Search ..... 431/297, 289, 295

[56] References Cited

UNITED STATES PATENTS

| | | | |
|---|---|---|---|
| 1,857,957 | 5/1932 | Hirschl | 431/297 |
| 2,689,470 | 9/1954 | Turner | 431/297 |
| 2,741,110 | 4/1956 | Thompson | 431/297 |
| 2,750,775 | 6/1956 | Robertson et al. | 431/297 |
| 3,307,380 | 3/1967 | Mailloux | 431/297 |

FOREIGN PATENTS OR APPLICATIONS

| | | | |
|---|---|---|---|
| 1,056,532 | 10/1953 | France | 431/297 |

*Primary Examiner*—Paul E. Maslousky
*Attorney, Agent, or Firm*—Barlow & Barlow

[57] ABSTRACT

The method of mounting a candle comprising the formation of a cup having a fixed diameter opening into which a candle may be placed. The mounting of this cup in a candlestick by means of imbedding the same in wax or easily molten material, in the recess of the candlestick and then paring down the base of the candle to the fixed diameter of the cup which will be uniform for each cup to mount the candle securely in position.

2 Claims, 7 Drawing Figures

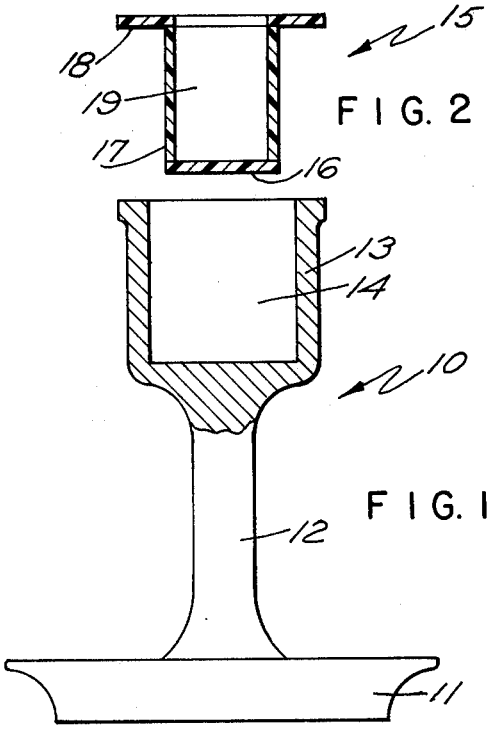
FIG. 2
FIG. 1
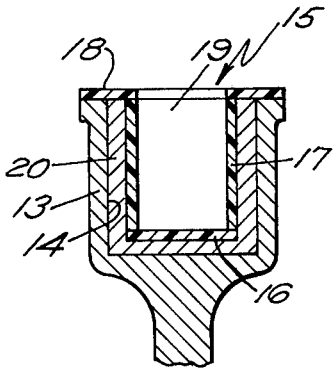
FIG. 3
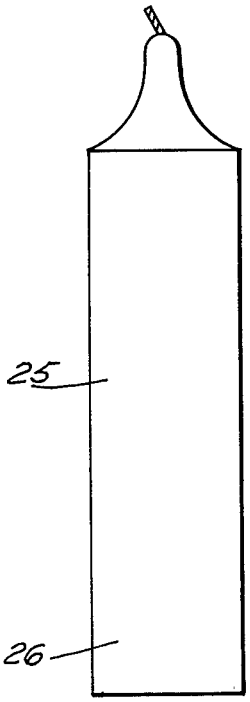
FIG. 4
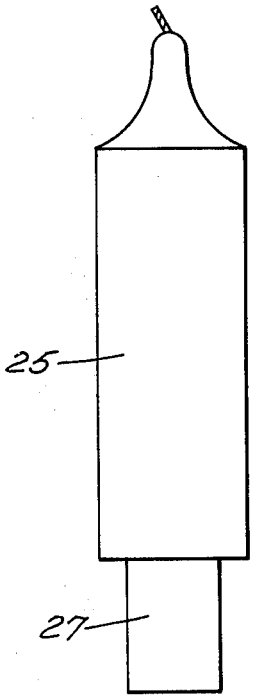
FIG. 5
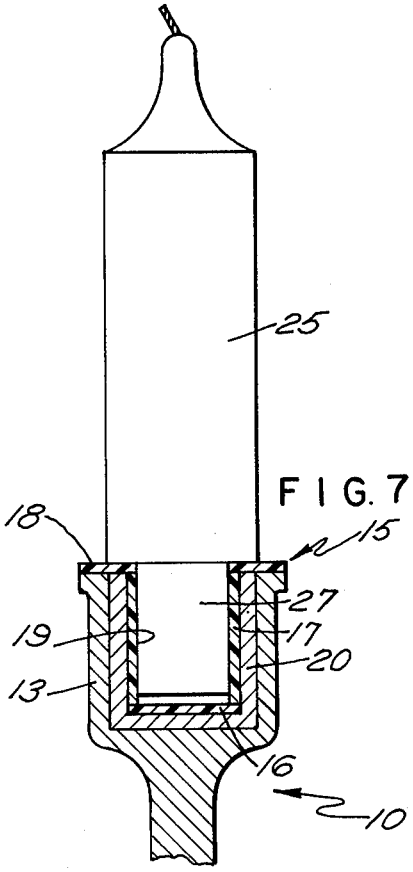
FIG. 7
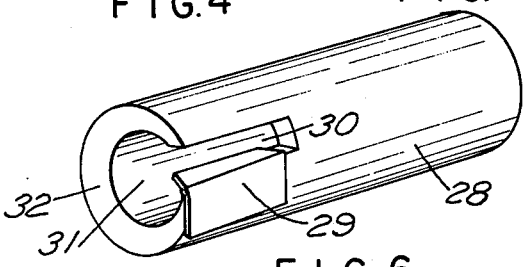
FIG. 6

METHOD OF MOUNTING A CANDLE

BACKGROUND OF THE INVENTION

Candlestick holders have recesses of various sizes and in purchasing a candle it is difficult to find a candle having a base which will exactly fit the candle holder in which it is desired to place the candle. Various ways of handling this situation have been attempted such, for instance, as the providing of the base of a candle with a spirally wrapped sheet which may be unwrapped in order to provide the desired diameter base of the candle such, for instance, as U.S. Pat. No. 1,857,957 May 10, 1932. In another instance different size removable cups have been provided on the base of the candle with the cups being telescoped into each other so that one may be removed from the other until the desired size for the candlestick holder has been arrived at as in U.S. Pat. No. 2,057,943. In other instances some sort of a resilient cup has been provided to take up the difference between the base of the candle and the size of the cup.

SUMMARY OF THE INVENTION

In this particular case a cup having a uniform inside diameter has an outside diameter the same as or smaller than the size of the candlestick holder and the cup is mounted in the candlestick holder in molten wax either by dripping the wax around the holder after positioned or by placing molten wax in the recess of the candlestick holder and positioning the cup within the holder to force the wax up around the outer side wall of the cup and then let the wax cool and become solid to secure the cup in position. Thereafter the candle base is pared down to the inside size of the opening in the cup and placed therein in a good secure position.

DESCRIPTION OF THE DRAWINGS

FIG. 1 is a sectional view of the candlestick holder;

FIG. 2 is a sectional view of the cup which is to be placed therein;

FIG. 3 is a sectional view showing the cup in the candlestick holder and surrounded by wax to hold the same firmly in position;

FIG. 4 is an elevational view of a candle;

FIG. 5 is a similar elevation showing the base of the candle reduced in size to fit the cup which is positioned in the candlestick holder;

FIG. 6 is a perspective view of a device for paring the base of the candle to the size desired;

FIG. 7 is a sectional view showing the candle mounted in the cup which is mounted in the recess of the candlestick holder.

DESCRIPTION OF THE PREFERRED EMBODIMENT

A candlestick holder such as shown at 10 in FIG. 1 may be of various forms but all of these candlestick holders have essentially a base 11, a stem 12 and a candle receiving upper end 13 which has a recess 14 therein. Such recesses vary in diameter or size, and the method herein set forth embodies and is adapted to use various size recesses. FIG. 2 shows a cup designated generally 15 having a bottom wall 16 and cylindrical side wall 17 with a flange 18 extending outwardly from its upper edge. The interior of this cup 19 is cylindrical and opens upwardly as shown in FIG. 2 as also does the recess 14 in FIG. 1. The opening 19 is of a fixed diameter and uniform for the system or method here disclosed.

In order to mount the cup in the recess 14, it is to be surrounded by some material which may be inserted in a liquid or viscous form and then will become solid. Such materials may be wax, plaster of Paris, glue or various plastics. For example, wax may be used which will easily melt and become molten. One way of surrounding this cup with wax is by placing the molten wax into the recess 14 and then placing the cup with its closed bottom wall 16 into this recess 14 so that the liquid wax will be forced up around the cylindrical side wall 17 of the cup as shown at 20 in FIG. 3. The wax which has been heated to be molten is then allowed to cool and the cup is firmly set into the recess. In other cases the cup may be first placed in the recess 14 and the wax in liquid form then put into the recess 14.

Thus there is provided a candlestick holder with a cup therein having a uniform size internal diameter. A candle 25 is shown in FIG. 4 which has a base portion 26 which may be of varying sizes. In order to mount this candle in the cup, the base is reduced as at 27 by means of a tool designated 28 which consists of a tubular formation having a cutter 29 inserted in a slot 30 in the wall thereof. The tool 28 is tubular having a hollow center 31 with the wall of the tube beveled at its upper edge 32 which will be of a size to receive the base 26 of the candle and by turning and pressing the candle base may be received into the hollow center 31 of this device 28 which will be of a diameter about the same as the diameter 19 of the cup into which it is to fit and then the candle may be inserted in the cup as shown in FIG. 7 to be securely mounted in position. The tool may be of various materials with the cutter added or may be molded of plastic material with the blade of the cutter molded in place therein.

Performing the method described above provides a positive means of making almost any candle stand firm and up-right in almost any candlestick holder.

I claim:

1. In the method of mounting a candle with a solid circular end diameter base comprising providing a candlestick holder having an upwardly opening recess therein and a cup with a uniform inner surface diameter and an imperforate bottom and an upstanding side wall of an outer size to fit into said recess, placing said cup in said recess with molten material surrounding said upstanding side wall, allowing the molten material to solidify and secure the cup in said recess, reducing by showing the solid base of said candle to a uniform circular diameter to fit within the upstanding wall of said cup and mounting the candle in said cup with its base against the inner surface thereof.

2. The method of claim 1 wherein said cup is inserted in said recess the molten material is caused to rise therein about the upstanding side wall of said cup.

* * * * *